US006505656B2

(12) United States Patent
Schultz et al.

(10) Patent No.: US 6,505,656 B2
(45) **Date of Patent: *Jan. 14, 2003**

(54) CONTAINER STRENGTHENING SYSTEM

(75) Inventors: Robert H. Schultz, Golden, CO (US); Christopher S. Derks, Arvada, CO (US); Elizabeth J. McTeer, Arvada, CO (US)

(73) Assignee: Coors Brewing Company, Golden, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/081,638

(22) Filed: Feb. 21, 2002

(65) Prior Publication Data

US 2002/0134459 A1 Sep. 26, 2002

Related U.S. Application Data

(63) Continuation of application No. 09/812,640, filed on Mar. 20, 2001.

(51) Int. Cl.[7] ..... B65B 31/00

(52) U.S. Cl. ..... 141/70; 141/5; 141/63; 141/82; 141/92; 141/199

(58) Field of Search ..... 141/4, 5, 6, 7, 141/8, 9, 11, 12, 47–50, 63–66, 69, 70, 82, 89, 91, 92, 156, 157, 159, 160, 161, 198, 199, 200, 201, 205

(56) References Cited

U.S. PATENT DOCUMENTS 6,378,571 B1 * 4/2002 Schultz et al. ..... 141/70

* cited by examiner

*Primary Examiner*—Gregory Huson
*Assistant Examiner*—Peter deVore
(74) *Attorney, Agent, or Firm*—Klaas, Law, O'Meara & Malkin, P.C.; Nellie C. Kaufman; William P. O'Meara

(57) ABSTRACT

A system for strengthening containers in a high-speed filling operation is disclosed. The system includes a solenoid-driven injector apparatus positioned at an angle to the containers being filled. The injector apparatus includes a chamber connected via an intake line to a supply tank. A solenoid is adapted to open an injector valve, allowing liquefied gas within a chamber to forcibly flow through an outflow line into the container. The solenoid is also adapted to close the injector valve, thereby blocking the liquefied gas within the chamber from entering the outflow line. The injector apparatus also includes a heater positioned adjacent to the outflow line and an adjustment device for the injector valve.

9 Claims, 7 Drawing Sheets

CONTAINER STRENGTHENING SYSTEM

CROSS-REFERENCE TO RELATED APPLICATION

The present application is a continuation of co-pending U.S. patent application Ser. No. 09/812,640 filed Mar. 20, 2001 for CONTAINER STRENGTHENING SYSTEM of Robert H. Schultz et al., which is hereby specifically incorporated by reference for all that is disclosed therein.

FIELD OF THE INVENTION

The present invention relates generally to container strengthening systems, and, in particular, to liquefied gas injection systems used to strengthen containers.

BACKGROUND OF THE INVENTION

Carbonated beverages, such as soft drinks and beer, are commonly packaged in metallic containers such as aluminum cans. The carbonation within the beverage exerts pressure on the containers, thereby increasing the strength of the container walls. However, it is generally desirable to further strengthen the containers in order to decrease the likelihood of damage to the containers as well as minimize the necessary thickness of the container walls.

One method used for strengthening containers is to deposit a liquefied gas such as nitrogen onto the beverage immediately prior to sealing the container. After sealing, the evaporated liquefied gas creates pressure within the container and also displaces oxygen from the headspace, thereby helping to prevent spoilage of the beverage. Many devices used to accomplish this result simply lay the liquefied gas onto the surface of the beverage, rather than forcibly injecting the liquefied gas into the beverage. This may suffice for non-carbonated beverages as well as some carbonated beverages. However, with a carbonated beverage such as beer that tends to produce a frothy head upon filling the container, liquefied gas deposited within the container tends to roll off the frothy head of the beverage and out of the container.

One solution would be to forcibly inject a liquefied gas such as nitrogen into the beverage utilizing a high-performance, quick-responding solenoid. However, due to the extremely cold temperatures involved in utilizing liquefied gas, a solenoid-controlled injector system must be carefully designed to avoid atomization of the liquid, which may occur when the liquefied gas is not properly passed through various inlets and/or outlets within the system. Furthermore, the pressure within the system must be carefully controlled in order to deliver a consistent amount of liquid nitrogen to each container in a high-speed filling operation.

SUMMARY OF THE INVENTION

The present invention is directed to a system for strengthening containers in a high-speed filling operation. The system may include a solenoid-driven injector apparatus positioned at an angle to the containers being filled. The injector apparatus may comprise an intake line in fluid flow relation with the supply tank, and a chamber in fluid flow relation with the intake line. The injector apparatus may also comprise an injector valve located within the chamber which includes a needle stem, a valve seat within a valve body, and a substantially straight outflow line which leads to the containers being filled. An adjustment device may also be provided for adjusting the position of the valve seat relative to the needle stem. The injector apparatus may further comprise a solenoid operatively connected to the needle stem, and a biasing device biasing the needle stem toward the valve seat. A heater may also be provided adjacent to the outflow line. The injector apparatus has an open operating state whereby the needle stem is positioned away from the valve seat, allowing liquefied gas within the chamber to flow out of the outflow line and into one of the containers. The injector apparatus also has a closed operating state whereby the needle stem is seated within the valve seat, blocking the liquefied gas within the chamber from entering the outflow line.

BRIEF DESCRIPTION OF THE DRAWINGS

Illustrative and presently preferred embodiments of the invention are illustrated in the drawings in which.

DESCRIPTION OF THE PREFERRED EMBODIMENTS

Figure 1:
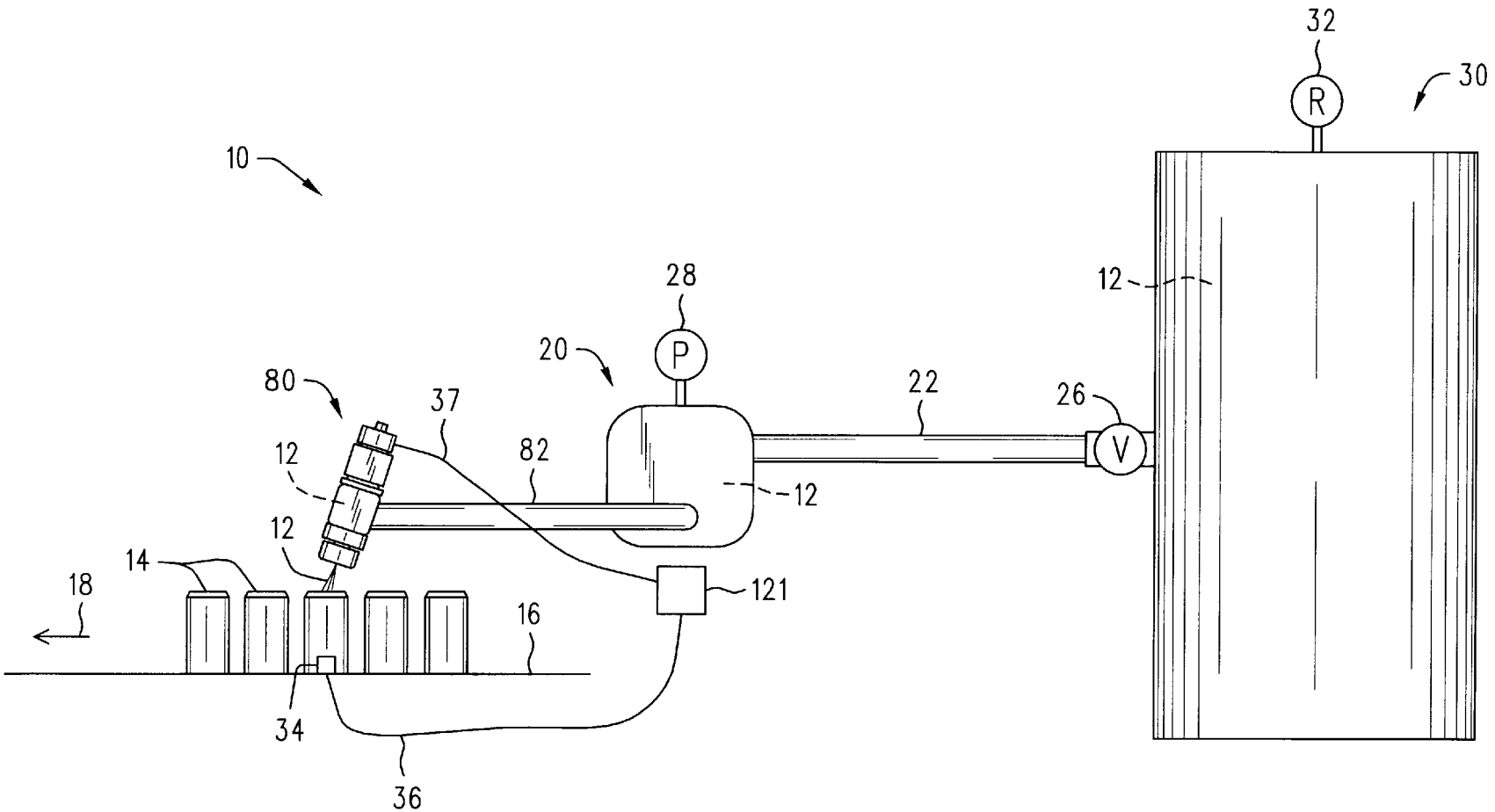
FIG. 1 is a front view of an exemplary container strengthening system of the present invention.
Figure 2:
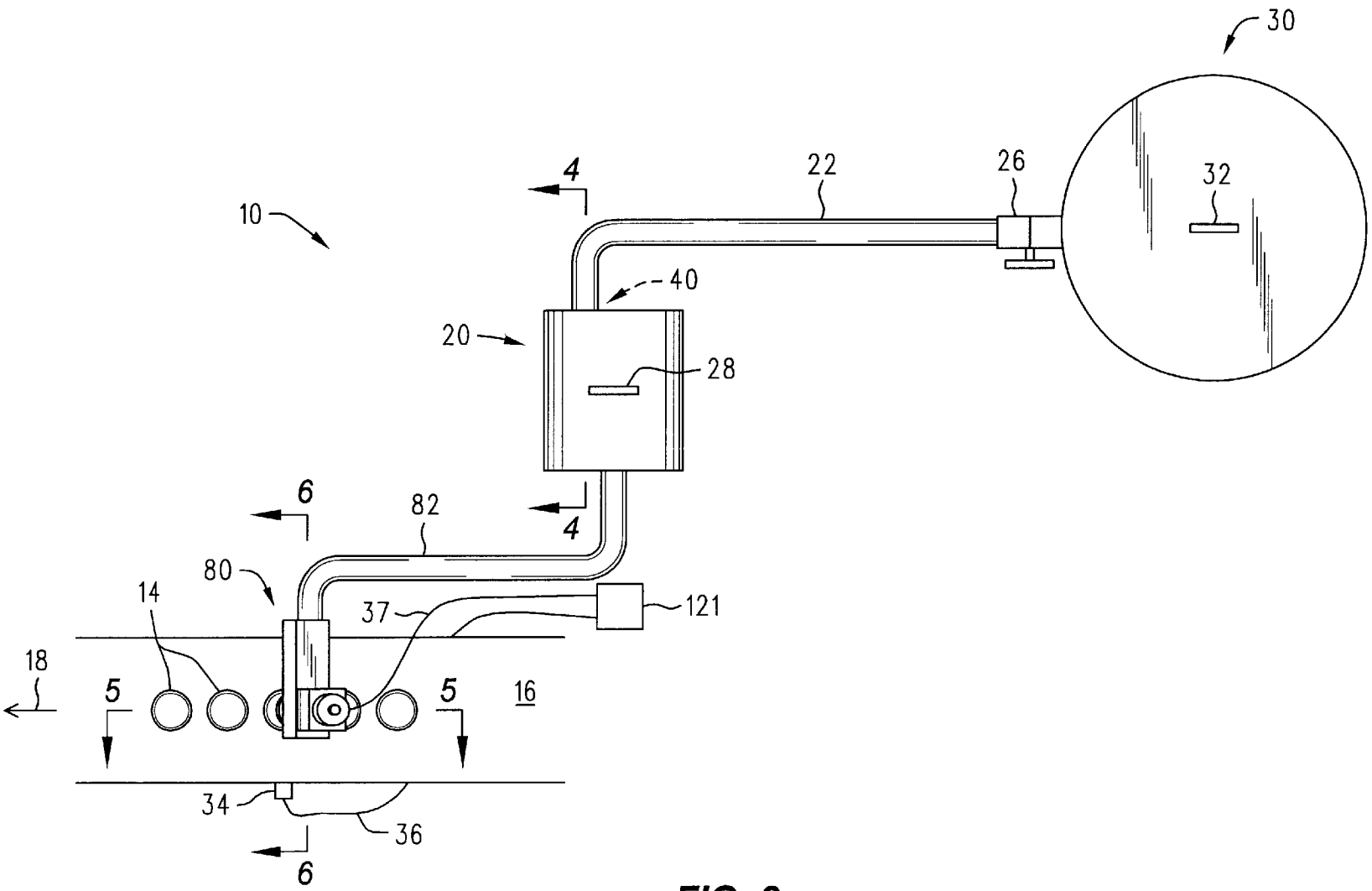
FIG. 2 is a top view of the container strengthening system of FIG. 1.

FIGS. 1 and 2 illustrate the container strengthening system 10 of the present invention. The container strengthening system 10 is adapted to forcibly inject a liquefied gas 12 such as nitrogen into containers 14 such as, for example, metallic cans, in a high-speed filling operation. The containers 14 may contain a beverage such as beer which frequently develops a frothy head during filling of the containers 14. The system 10 preferably injects the liquefied gas 12 into the containers 14 with an adequate force such that the liquefied gas 12 remains within the container 14 and does not roll off the frothy head of the beverage therein.

The container strengthening system 10 may comprise a supply tank 20 comprising a first intake line 22 in fluid flow relation with a source 30 of liquefied gas 12. The source 30 of liquefied gas 12 may be, for example, a tank having a relief valve 32 (schematically illustrated by the designation "R") to maintain the pressure of the liquefied gas 12 therein at an adequate level, e.g. 25 psi, to force the liquefied gas 12 through the first intake line 22 to the supply tank 20. The source 30 of liquefied gas may alternatively be a bulk holding tank (not shown), whereby the liquefied gas 12 may be piped in through the first intake line 22 to the supply tank 20. The liquefied gas 12 may be any non-oxidizing gas such as, for example, liquid nitrogen conventionally added to products such as non-carbonated beverages to increase the pressure within their containers 14 and also to displace oxygen from the headspace above the beverage in the containers 14. The first intake line 22 may comprise a shutoff valve 26 (schematically illustrated by the designation "V") which may open and close the line 22 to the source 30 of liquefied gas 12 as desired.

Figure 3:
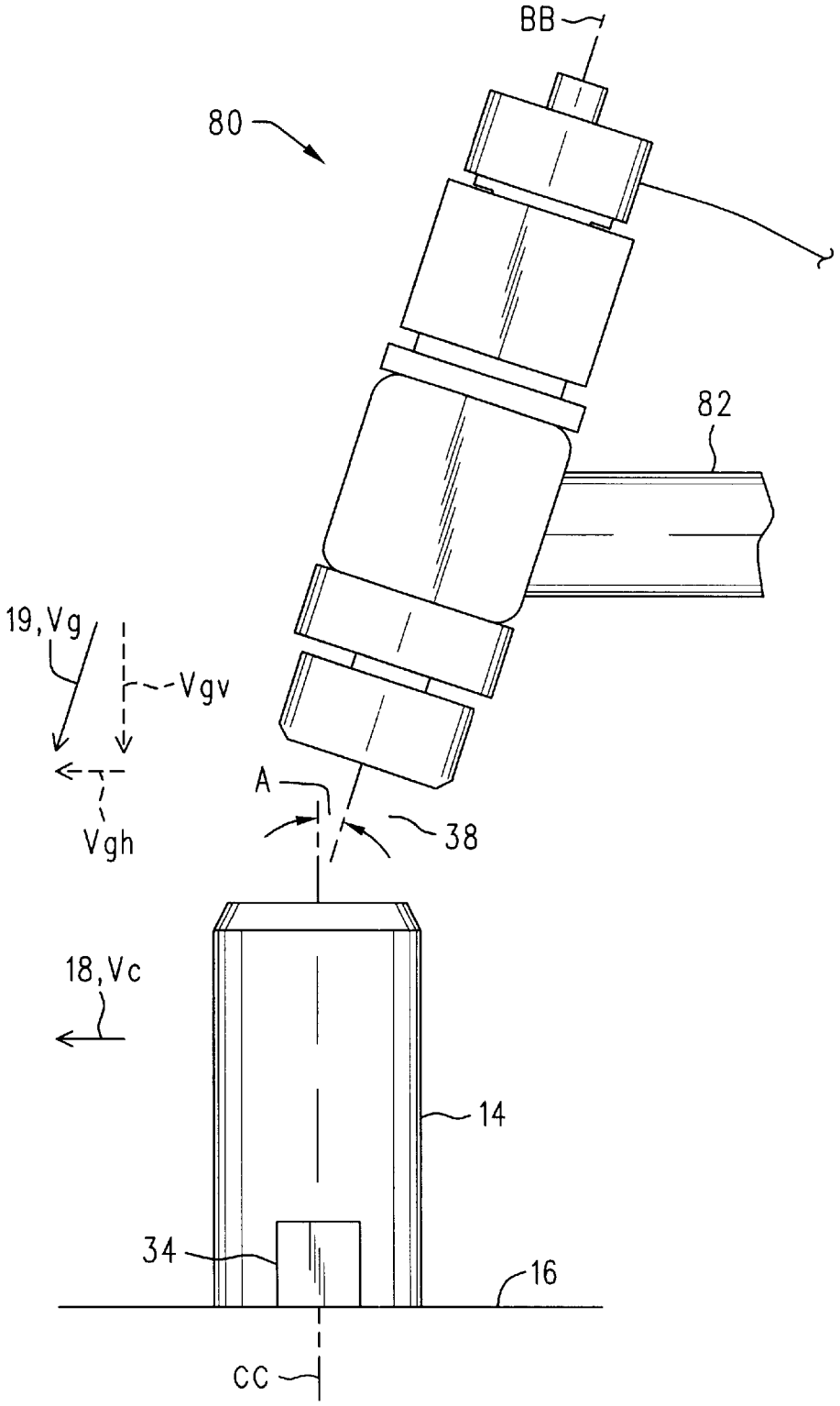
FIG. 3 is an enlarged, front view of a container and an injector apparatus of the container strengthening system of FIGS. 1 and 2.
Figure 4:
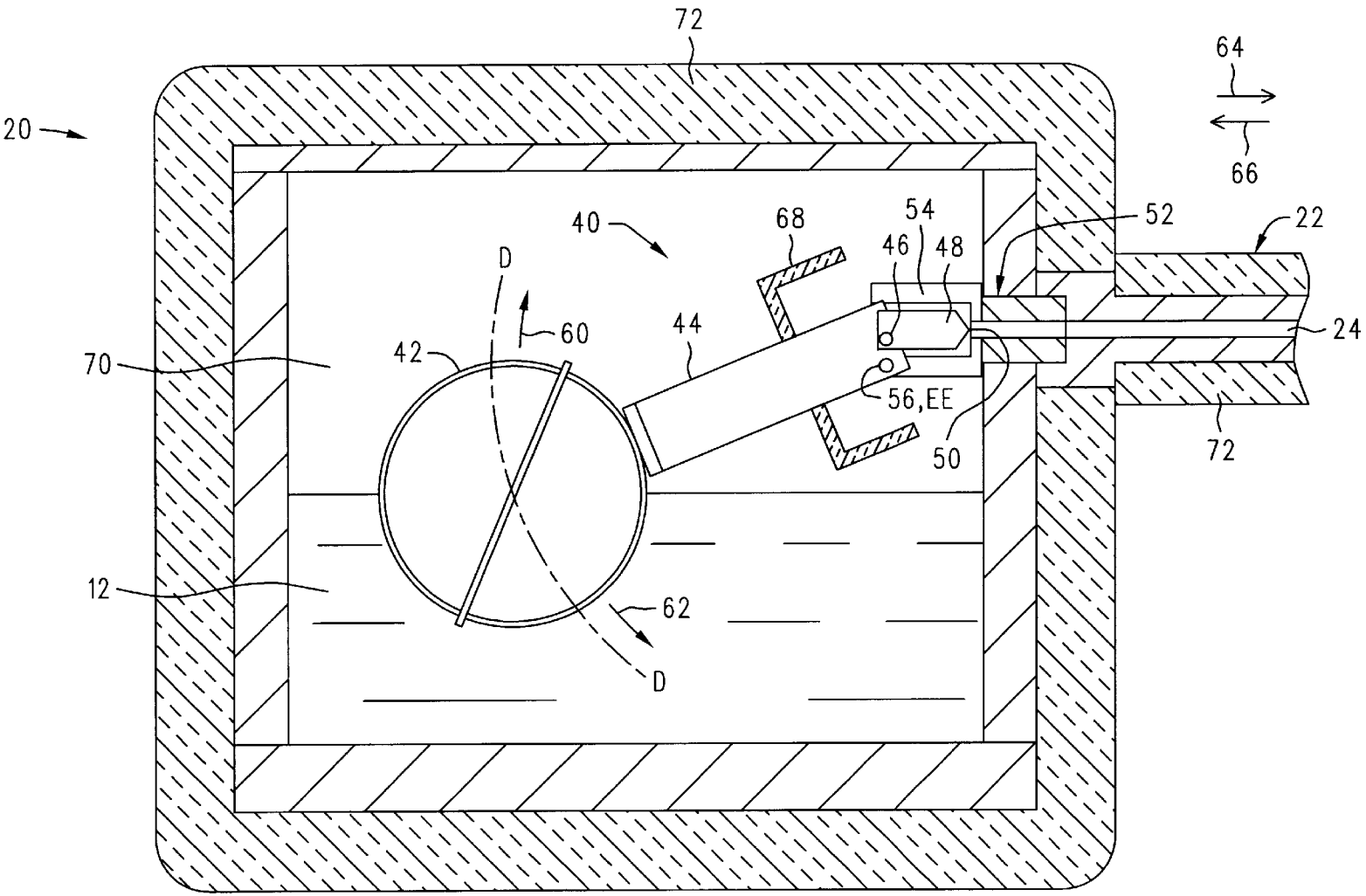
FIG. 4 is a cross-sectional view of a supply tank of the container strengthening system of FIGS. 1 and 2.

The supply tank 20 may further comprise a liquid level control valve 40 (FIG. 2, and described in more detail below with reference to FIG. 4). The liquid level control valve 40 is in fluid flow relation with the first intake line 22 and controls the level of liquefied gas 12 within the supply tank 20. The supply tank 20 may further comprise a back pressure regulator 28 (schematically illustrated by the designation "P") to carefully control the pressure within the tank 20 (which in turn maintains an appropriate pressure within the injector apparatus 80 described below), as is necessary to maintain proper dosing of the liquefied gas 12 into the containers 14. Any conventional back pressure regulator 28 which is adapted for use with liquefied gas such as nitrogen may be utilized to control the pressure in the supply tank 20, such as, for example, back pressure regulator #44-4761-24-501 manufactured by Tescom Corporation of Elk River, Minn. In order to supply adequate force with which to inject the liquefied gas 12 into the containers 14, the pressure in the supply tank 20 is preferably maintained by the back pressure regulator 28 at between about 1 psi and 5 psi, and most preferably approximately 3 psi. A pressure in the supply tank 20 which is too low may cause the liquefied gas 12 injected into the containers 14 to roll off the frothy head of the beverage therein. However, a pressure in the supply tank 20 which is too high may simply cause the liquefied gas 12 being injected into the containers 14 to atomize into the atmosphere 38 (FIG. 3) above the containers 14.

The system 10 may further comprise an injector apparatus 80, described in detail below relative to FIGS. 5–7, comprising a second intake line 82 in fluid flow relation with the supply tank 20. As shown in FIGS. 1–2, the injector apparatus 80 may be positioned directly above a conventional conveyor 16 or the like carrying a row of containers 14 past the injector apparatus 80 in a horizontal direction 18 at a velocity "Vc". In a high-speed filling operation, this velocity "Vc" may be, for example, 4000 inches/minute (utilizing standard beverage cans, this translates to approximately 1000 cans/minute). As best shown in FIG. 3, the injector apparatus 80 is preferably positioned at an angle "A" to each container 14, thereby injecting liquefied gas 12 into the containers 14 in an angled, downward direction 19 at a velocity "Vg". As shown in FIG. 3, the angle "A" is the angle between the central longitudinal axis "BB" of the injector apparatus 80 and the central longitudinal axis "CC" of a container 14. This angle "A" may be determined by the velocity "Vc" of the containers 14 traveling past the injector 80. Specifically, the velocity "Vc" of the containers 14 only has a horizontal component, while the velocity "Vg" of the liquefied gas 12 has both a horizontal component "Vgh" and a vertical component "Vgv". Ideally, the injector apparatus 80 is angled so that the horizontal component "Vgh" of the velocity "Vg" of the liquefied gas 12 is equal to the velocity "Vc" of the containers 14. The closer "Vgh" is to "Vc", the less the possibility that the liquefied gas 12 will splash and roll off of the beverage's frothy head and out of the container 14. In a high-speed filling operation whereby "Vc" is approximately 4000 inches/minute, this angle "A" is preferably between about 15 and 18 degrees, and most preferably approximately 18 degrees.

As shown in FIGS. 1–3, the system 10 may further comprise a sensor 34 which senses the presence of a container 14 below the injector apparatus 80. The sensor 34 is operatively connected via line 36 to a solenoid driver 121 which is then connected via line 37 to the injector apparatus 80, and specifically to the solenoid 120 of the injector apparatus 80 described in further detail below with reference to FIGS. 5 and 6. The sensor 34 may be of the type conventionally known in the art, such as sensor #9-251-03 manufactured by Sencon, Inc. of Bedford Park, Ill. Upon sensing the presence of a container 14, the sensor 34 actuates the solenoid 120, causing the liquefied gas to forcibly flow from the injector apparatus 80 into the container 14.

As noted above and shown in FIG. 4, the liquid level control valve 40 is in fluid flow relation with the first intake line 22 and may be used to control the level of liquefied gas 12 within the supply tank 20. The liquid level control valve 40 prevents liquefied gas 12 from entering the back pressure regulator 28 (shown schematically in FIGS. 1 and 2), thereby preventing freezing and failure of the back pressure regulator without the need for a separate heater adjacent to the back pressure regulator. As shown in FIG. 4, the liquid level control valve 40 may comprise a float 42 fixedly attached to a rod 44. The rod 44 may be hingedly connected with a first pin 46 to a needle stem 48 which is adapted to be received by a valve seat 50. The valve seat 50 may be an opening within a valve body 52 which is directly connected to the opening 24 of the first intake line 22. The valve body 52 may comprise a flange 54 which acts as a linear guide for the needle stem 48. The rod 44 may also be hingedly connected with a second pin 56 to the valve body 52. As shown in FIG. 4, the float 42 is translatable in an arcuate direction 60, 62 along axis DD around axis EE which is defined by the second pin 56 connecting the rod 44 to the valve body 52. As the level of liquefied gas 12 within the tank 20 increases causing the float 42 to rise in direction 60 along axis DD, the rod 44 pushes the needle stem 48 in a linear direction 64 toward the valve seat 50. When the float 42 has risen to a predetermined maximum level within the supply tank 20, the needle stem 48 completely blocks off the valve seat 50 so that no liquefied gas 12 may enter the first intake line 22. The maximum level is determined by the location of the back pressure regulator 28, which is preferably connected to (or close to) the top surface 21 (FIGS. 1 and 2) of the supply tank 20. At levels close to the maximum, the needle stem 48 may only partially block the flow of liquefied gas 12 into the supply tank 20. As the level of liquefied gas 12 within the tank 20 decreases, causing the float 42 to lower in direction 62 along axis DD, the rod 44 pulls the needle stem 48 in a linear direction 66 away from the valve seat 50, allowing the liquefied gas 12 to flow from the first intake line 22 into the tank 20. The liquid level control valve 40 may further comprise a baffle 68, which may consist simply of the bottom portion of a Styrofoam cup, located in the proximity of the first intake line 22. The baffle 68 interrupts the flow of liquefied gas 12 into the supply tank 20 to prevent atomization of the liquefied gas 12 in the atmosphere 70 above the liquefied gas 12 within the tank 20.

Due to the extremely cold temperatures involved in utilizing liquefied gas such as nitrogen, various parts of the system 10 (FIGS. 1 and 2) are preferably insulated. For example, as shown in FIG. 4, the supply tank 20 and first intake line 22 may be covered with insulation 72. As shown in FIG. 5, the second intake line 82, as well as the entire injector apparatus 80, may also be covered with insulation 72. In all of the figures, the insulation has been removed from the injector apparatus 80 for clarity.

Figure 5:
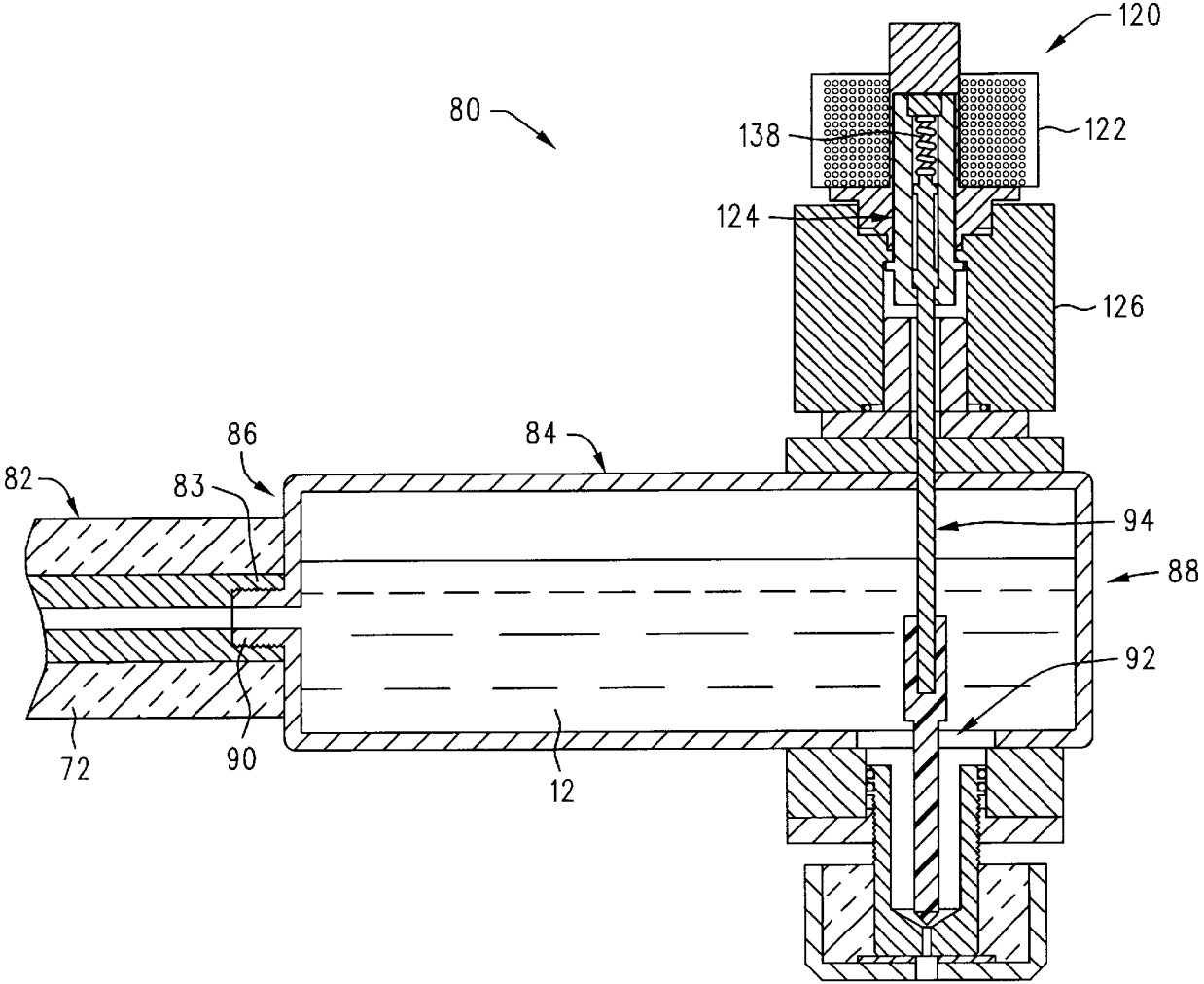
FIG. 5 is a cross-sectional view of the injector apparatus of the container strengthening system of FIGS. 1 and 2.
Figure 6:
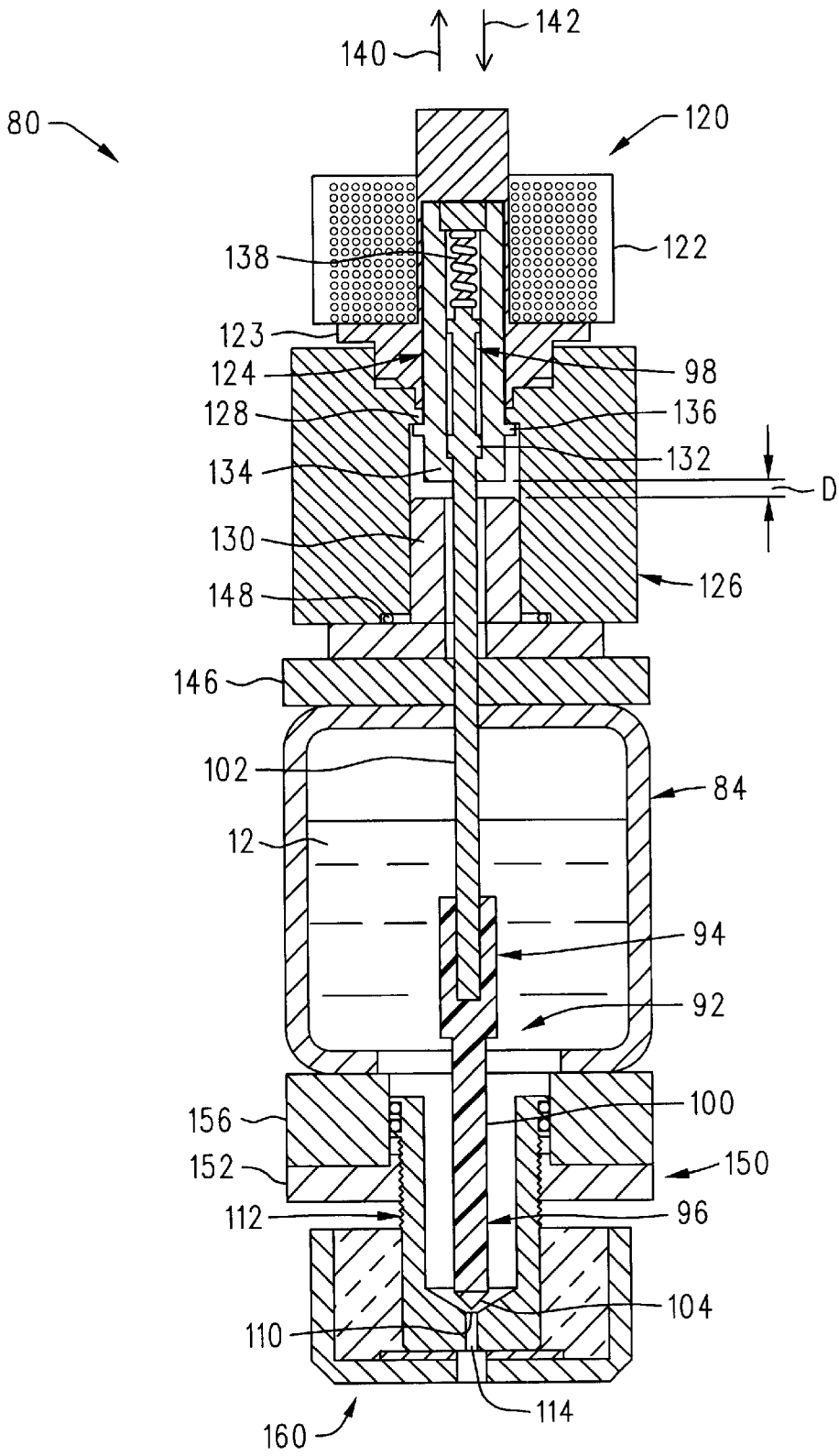
FIG. 6 is another cross-sectional view of the injector apparatus of FIG. 5.
Figure 7:
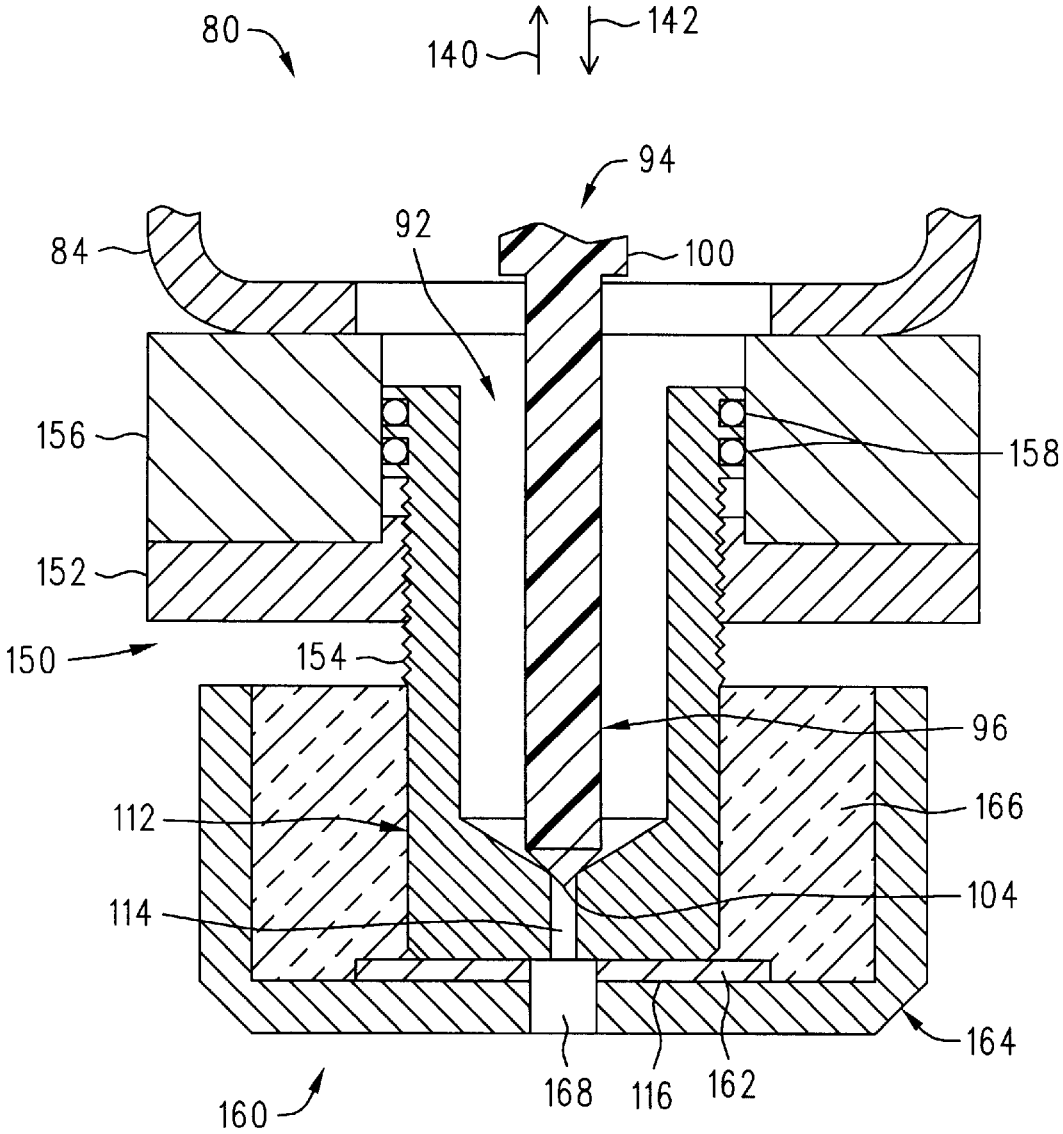
FIG. 7 is an enlarged view of a portion of the injector apparatus of FIG. 5.

Referring now to FIGS. 5–7, the injector apparatus 80 may further comprise a chamber 84 in fluid flow relation with the supply tank 20. As best shown in FIG. 5, the chamber 84 may comprise a first end 86 having a threaded portion 90 which may be secured to a threaded portion 83 of the second intake line 82. The injector apparatus 80 may further comprise an injector valve 92 located within the chamber 84 near the second end 88 thereof. As best shown in FIG. 6, the injector valve 92 may comprise a needle stem 94 having a first end 96 and a second end 98, a valve seat 110, and a substantially straight outflow line 114. The needle stem 94 may be comprised of a first needle portion 100 fixedly attached to a second needle portion 102. The first needle portion 100 may comprise a pointed end 104 which is adapted to be received by the valve seat 110. The valve seat 110 may have a substantially conical shape as shown in FIGS. 5–7 to best accommodate the pointed end 104 of the first needle portion 100. The first needle portion 100 may be manufactured from a plastic material such as, for example, Teflon, which tends to be very durable in extremely cold temperatures. The second needle portion 102 may be manufactured from stainless steel or the like. As best shown in FIG. 7, the valve seat 110 may be an opening within a valve body 112 which is directly connected to the outflow line 114. As noted above, the outflow line 114 is preferably substantially straight, since an outflow line that is bent, curved, or the like may cause the exiting liquefied gas 12 (FIGS. 5 and 6) to atomize in the atmosphere 38 (FIG. 3) above the containers 14, rather than being deposited within the containers 14 as desired.

The injector apparatus 80 may comprise an "open" operating state as shown in FIGS. 5 and 6 whereby the needle stem 94 is positioned away from the valve seat 110, allowing liquefied gas 12 to flow out the outflow line 114. The injector apparatus 80 may also comprise a "closed" operating state as shown in FIG. 7 whereby the needle stem 94 is seated within the valve seat 110, blocking the liquefied gas 12 (FIGS. 5 and 6) from entering the outflow line 114.

As shown in FIGS. 5 and 6, the injector apparatus 80 may further comprise a solenoid 120 operatively connected to the sensor 34 (FIGS. 1–3) via a solenoid driver 121 (FIGS. 1–2) and to the needle stem 94. The solenoid driver 121 may be of the type conventionally known in the art, such as driver #LST-22-DV manufactured by Sencon, Inc., of Bedford Park, Ill. As best shown in FIG. 6, the solenoid 120 may comprise a solenoid coil 122, a coil housing 123, an armature 124 preferably manufactured from stainless steel or iron, a housing 126 comprising an armature back stop 128, and an armature forward stop 130. The solenoid coil 122 may be a conventional, high-performance, quick-responding solenoid coil such as Skinner solenoid coil #L322 manufactured by Parker Hannifin Corporation of Cleveland, Ohio. The housings 123, 126 may be manufactured from stainless steel.

The armature 124 is attached to the needle stem 94 in a manner which causes the needle stem 94 to travel with the armature 124. Specifically, the needle stem 94 may comprise a flange 132 which engages a first flange 134 in the armature 124. When the sensor 34 (FIGS. 1–3) sends a signal to the solenoid 120, the coil 122 is energized for a predetermined amount of time "t" which may be set on the solenoid driver 121 (FIGS. 1–2) and which correlates to the desired amount of liquefied gas 12 to be injected into a container 14. In a high-speed filling operation, the predetermined amount of time "t" set on the solenoid driver 121 may be approximately 10–20 milliseconds. When the coil 122 is energized, a magnetic force is created, causing the armature 124 to travel in an upward direction 140 until a second flange 136 on the armature 124 reaches the back stop 128 in the housing 126. Since the needle stem 94 is connected to the armature 124 as noted above, this upward action by the armature 124 pulls the needle stem 94 away from the valve seat 110 and allows liquefied gas 12 to flow out of the outflow line 114. The injector apparatus 80 is then in the "open" operating state (FIGS. 5 and 6). A biasing device 138 such as a spring may be positioned adjacent to the second end 98 of the needle stem 94 to bias the first end 96 of the needle stem 94 toward the valve seat 110. Thus, when the coil 122 is no longer energized (i.e., when a predetermined amount of liquefied gas 12 has exited the outflow line 114 into a container 14), the needle stem 94 is pushed by the biasing device 138 in a downward direction 142 toward the valve seat 110 such that the needle stem 94 blocks the outflow line 114 from receiving liquefied gas 12. As the needle stem 94 moves downwardly 142, the armature 124 is urged toward the forward stop 130, and the injector apparatus 80 is then in the "closed" operating state (FIG. 7).

As shown in FIG. 6, the distance "D" between the forward stop 130 and the armature 124 when the armature 124 is adjacent to the back stop 128 defines the "stroke" of the armature 124. A high performance, quick-responding solenoid typically has a very limited stroke which may be, for example, on the order of 0.08 inches. The stroke of the armature 124 is typically slightly (e.g., 0.005 to 0.01 inches) more than the stroke of the needle, i.e., the distance that the needle stem 94 travels in each direction 140,142. As best shown in FIG. 6, the injector apparatus 80 may further comprise an adjuster 146 which assists in mounting the solenoid 120 to the chamber 84. A Teflon O-ring 148 may be provided between the adjuster 146 and the housing 126 to prevent leakage of the liquefied gas 12.

As shown in FIGS. 6 and 7, the injector apparatus 80 may further comprise an adjustment device 150 operatively connected to the valve seat 110 (FIG. 6) for adjusting the position of the valve seat 110 relative to the needle stem 94. Because a high-performance, quick-responding solenoid has a very limited stroke ("D" in FIG. 6) as described above, some allowance must be made for manufacturing tolerance buildup between the valve seat 110 and the pointed tip 104 of the needle stem 94. The adjustment device 150 is provided in order to ensure that the needle stem 94 is seated properly within the valve seat 110 when the injector apparatus 80 is in the "closed" operating state, and that adequate clearance is provided between the needle stem 94 and the valve seat 110 in the "open" operating state, thus providing a proper dosage of liquefied gas 12 into the containers 14 and avoiding atomization of the exiting liquefied gas 12. As shown in FIG. 7, the adjustment device 150 may comprise a threaded engagement device 152 which engages a threaded portion 154 of the valve body 112. The threaded engagement device 152 and valve body 112 may be manufactured from stainless steel. The valve body 112 may be adjusted in an upward direction 140 or a downward direction 142 by turning the valve body 112 relative to the engagement device 152. A housing 156 may be provided between the engagement device 152 and the chamber 84 (or, alternatively, the housing 156 and engagement device 152 may be a single component). The valve body 112 may also be provided with Teflon O-rings 158 between the valve body 112 and housing 156 to prevent leakage of the liquefied gas 12 (FIGS. 5–6).

Finally, as best shown in FIG. 7, the injector apparatus 80 may further comprise a heater 160 positioned adjacent to the outflow line 114 to prevent ice buildup within or just outside of the outflow line 114, e.g., on outer surface 116 of the valve body 112. The heater 160 may comprise at least one heating element 162 housed within a cap 164 which may be manufactured from stainless steel. Insulation 166 may be provided between the cap 164 and the valve body 112. An opening 168 may be provided in the cap 164 adjacent to the outflow line 114. The heater 160 may be secured to the valve body 112 by any conventional means such as by utilizing bolts, screws, adhesive, etc.

While illustrative and presently preferred embodiments of the invention have been described in detail herein, it is to be understood that the inventive concepts may be otherwise variously embodied and employed, and that the appended claims are intended to be construed to include such variations, except as limited by the prior art.

We claim:

1. An injector apparatus for injecting a liquefied gas into containers at an angle to said containers in a high-speed filling operation, comprising:

a) a central longitudinal axis which is positioned at an angle to the central longitudinal axis of said containers;

b) an first intake line in fluid flow relation with a supply tank;

c) a chamber in fluid flow relation with said first intake line;

d) an injector valve located within said chamber, said injector valve comprising a first needle stem having a first end and a second end, a first valve seat within a first valve body, and a substantially straight outflow line;

e) an adjustment device operatively connected to said first valve seat for adjusting the position of said first valve seat relative to said first needle stem;

f) a solenoid operatively connected to said first needle stem;

g) a biasing device adjacent to said second end of said first needle stem biasing said first end of said first needle stem toward said first valve seat;

h) a heater comprising at least one heating element positioned adjacent to said outflow line;

i) an open operating state whereby said needle stem is positioned away from said valve seat, allowing said liquefied gas within said chamber to flow out of said outflow line and into one of said containers; and j) a closed operating state whereby said needle stem is seated within said valve seat, blocking said liquefied gas within said chamber from entering said outflow line.

2. The apparatus of claim 1, further comprising a sensor operatively connected to said solenoid via a solenoid driver, whereby, upon sensing the presence of one of said containers, said sensor actuates said solenoid, thereby lifting said first needle stem away from said first valve seat and allowing liquefied gas to forcibly flow from said chamber through said outflow line at said angle into said one of said containers in said open operating state.

3. The apparatus of claim 1, said supply tank comprising a second intake line in fluid flow relation with a source of liquefied gas, and said apparatus further comprising a liquid level control valve in fluid flow relation with said second intake line.

4. The apparatus of claim 3, said liquid level control valve comprising:

a) a baffle adjacent to said second intake line;

b) a float;

c) a second needle stem having a first end and a second end;

d) a second valve seat within a second valve body, said second valve seat being in fluid flow relation with said second intake line of said supply tank and being adapted to receive said first end of said second needle stem; and e) a rod having a first end fixedly attached to said float and a second end hingedly attached to said second end of said second needle stem and hingedly attached to said valve body, whereby as the level of said liquefied gas rises within said supply tank, said float rises, causing said rod to push said second needle stem toward said valve seat.

5. The apparatus of claim 1, wherein said angle is between about 15 degrees and 20 degrees.

6. The apparatus of claim 1, said needle stem comprising a first needle portion on said first end thereof and a second needle portion on said second end thereof, said first needle portion being manufactured from Teflon.

7. The apparatus of claim 1, said valve body further comprising a threaded portion, said adjustment device comprising a threaded engagement portion which engages said threaded portion of said valve body, said valve body being adjustable in a linear direction relative to said first needle stem by turning said valve body relative to said threaded engagement portion.

8. The apparatus of claim 1, said solenoid comprising:

a) a solenoid coil operatively connected to said solenoid driver;

b) an armature comprising a first flange and a second flange, said first flange being engaged with a flange on said needle stem;

c) an armature back stop;

d) whereby, when said solenoid coil is energized, said second flange on said armature contacts said armature back stop and said needle stem is lifted by said armature.

9. The apparatus of claim 1, said heater further comprising a cap containing insulation and said at least one heating element, said cap being secured to said valve body.

* * * * *